US007104254B2

(12) United States Patent
Arai et al.

(10) Patent No.: US 7,104,254 B2
(45) Date of Patent: Sep. 12, 2006

(54) THROTTLE CONTROL APPARATUS HAVING PLATE-SHAPED INNER CONNECTING MEMBER

(75) Inventors: Tsuyoshi Arai, Kariya (JP); Naoki Hiraiwa, Toyokawa (JP); Hiroki Shimada, Obu (JP)

(73) Assignee: Denso Corporation, (JP)

( * ) Notice: Subject to any disclaimer, the term of this patent is extended or adjusted under 35 U.S.C. 154(b) by 91 days.

(21) Appl. No.: 10/891,084

(22) Filed: Jul. 15, 2004

(65) Prior Publication Data

US 2005/0022786 A1 Feb. 3, 2005

(30) Foreign Application Priority Data

Aug. 1, 2003 (JP) ..... 2003-285139

(51) Int. Cl.
*F02D 31/00* (2006.01)
*F02D 1/00* (2006.01)

(52) U.S. Cl. ..... 123/376; 251/129.01

(58) Field of Classification Search ..... 123/376, 123/337; 251/129.01, 129.11, 248, 305
See application file for complete search history.

(56) References Cited

U.S. PATENT DOCUMENTS 5,704,335 A 1/1998 Akutagawa et al.
RE36,627 E * 3/2000 Pink et al. ..... 15/347
6,036,172 A * 3/2000 Pajard ..... 251/250
6,295,968 B1 10/2001 Torii et al.
6,386,178 B1 * 5/2002 Rauch ..... 123/337
6,508,455 B1 * 1/2003 Rauch et al. ..... 251/305
6,761,348 B1 * 7/2004 Michels et al. ..... 251/305
2002/0104510 A1 * 8/2002 Kotchi et al. ..... 123/337
2005/0104581 A1 * 5/2005 Miyata et al. ..... 324/207.25

FOREIGN PATENT DOCUMENTS

JP 10-047520 2/1998
JP 11-132061 5/1999
JP 2001-263098 9/2001

* cited by examiner

*Primary Examiner*—John T. Kwon
(74) *Attorney, Agent, or Firm*—Nixon & Vanderhye PC

(57) ABSTRACT

A throttle body of an electrically controlled throttle apparatus is constructed with a bore wall part, a motor housing part receiving a heavy component such as a motor and a connecting member that connects the bore wall part and the motor housing part with each other. The bore wall part has a cylindrical inner periphery for rotatably receiving a circular-shaped throttle valve. The connecting member is constructed with plural plate-shaped ribs. Thus, the connecting member can be rigid without becoming a thick member. Therefore, the connecting member can be restricted from contracting in its molding process, so that circularity of the cylindrical inner periphery of the bore wall part can be maintained. Thus, the cylindrical inner periphery of the bore wall part can rotatably receive the circular-shaped throttle valve without arising interference against each other, and airtightness of the throttle valve can be maintained, when the throttle valve is in the full close position.

16 Claims, 7 Drawing Sheets

THROTTLE CONTROL APPARATUS HAVING PLATE-SHAPED INNER CONNECTING MEMBER

CROSS REFERENCE TO RELATED APPLICATION

This application is based on and incorporates herein by reference Japanese Patent Application No. 2003-285139 filed on Aug. 1, 2003.

FIELD OF THE INVENTION

The present invention relates to an electrically controlled throttle apparatus that controls an amount of intake air flowing into an internal combustion engine mounted in a vehicle such as an automobile.

BACKGROUND OF THE INVENTION

Conventionally, a drive unit such as a motor is used in an electrically controlled throttle apparatus to control a throttle valve to be in a predetermined throttle position in accordance with an accelerator position of an accelerator pedal stepped by a driver. According to an electrically controlled throttle apparatus disclosed in JP-A 10-047520, JP-A 2001-263098 and JP-A 2001-303983, a bore wall part and a motor housing part are integrally molded of a resinous material to construct a throttle body. Besides, according to JP-A 09-032590 and JP-A 11-132061, a throttle body has an outer pipe and an inner pipe that are coaxially arranged with each other to construct an integrally molded double-pipe structure, in which the inner pipe receives a throttle valve.

FIGS. 6 and 7 are perspective views showing a conventional electrically controlled throttle apparatus, for example. In the electrically controlled throttle apparatus, a throttle body 100 has a bore wall part 103 and a motor housing part 104. The bore wall part 103 is constructed with a cylindrical-shaped bore outer pipe 101 and a cylindrical-shaped bore inner pipe 102 that are coaxially arranged each other to construct a double-pipe structure. The motor housing part 104 receives a drive unit such as a motor that is heavy in weight. The bore wall part 103 includes the bore inner pipe 102 receiving a throttle valve 105. Therefore, both of the bore wall part 103 and the motor housing part 104 become heavy. Accordingly, when a connecting member 106, which connects the bore wall part 103 and the motor housing part 104, is additionally provided, the connecting member 106 needs to be rigid enough to support the heavy components. When the bore wall part 103, the motor housing part 104 and the connecting member 106 are integrally molded of a resinous material, the connecting member 106 may be formed to be thick in order to be rigid. When the connecting member 106 is molded, molecular orientation is caused by a resinous flow, and fiber included in a filler material may be oriented in a particular direction. Besides, the housing part 104 may contract in the molding process. Accordingly, circularity of the inner cylindrical periphery of the bore inner pipe 102 may be degraded. In this case, interference may arise between the throttle valve 105 and the bore inner pipe 102 over a rotation range of the throttle valve 105 from its full close position to its full open position. Furthermore, a gap, which is formed between the inner cylindrical periphery of the bore inner pipe 102 and the outer circumferential periphery of the throttle valve 105 when the throttle valve 105 is in the full close position, may become larger than a predetermined degree. Accordingly, airtightness may be degraded when the throttle valve 105 is in the full close position, and leakage of intake air increases in an idling operation of the engine.

SUMMARY OF THE INVENTION

It is an object of the present invention to provide an electrically controlled throttle apparatus including a bore wall part having a cylindrical inner periphery, in which circularity of the cylindrical inner periphery can be maintained in its molding process. Thus, a proper operation can be secured and airtightness of the throttle valve can be maintained in its full closed position.

According to the present invention, an electrically controlled throttle apparatus has a throttle body that includes a motor, a throttle valve, a bore wall part, a motor housing part and plural connecting members. The throttle valve is rotated by the motor. The bore wall part rotatably receives the throttle valve. The motor housing part receives the motor. The plural connecting members connect the bore wall part and the motor housing part with each other. The bore wall part, motor housing part and the connecting members are integrally molded. Each of the connecting members has a plate-shape.

The motor housing part is arranged on the radially outer side of the bore wall part via the connecting members (plate-shaped ribs). The connecting members protrude from a sidewall face of the bore wall part, and connect to a sidewall face of the motor housing part. The bore wall part has a substantially cylindrical shape. The throttle valve has a substantially disc-shape. The bore wall part has a substantially cylindrical inner periphery that forms an intake air passage through which intake air passes. The substantially disc-shaped throttle valve opens and closes the substantially cylindrical shaped intake air passage formed with the inner periphery of the bore wall part. The motor housing part has a substantially cylindrical shape. The motor housing part is arranged substantially parallel to the bore wall part.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
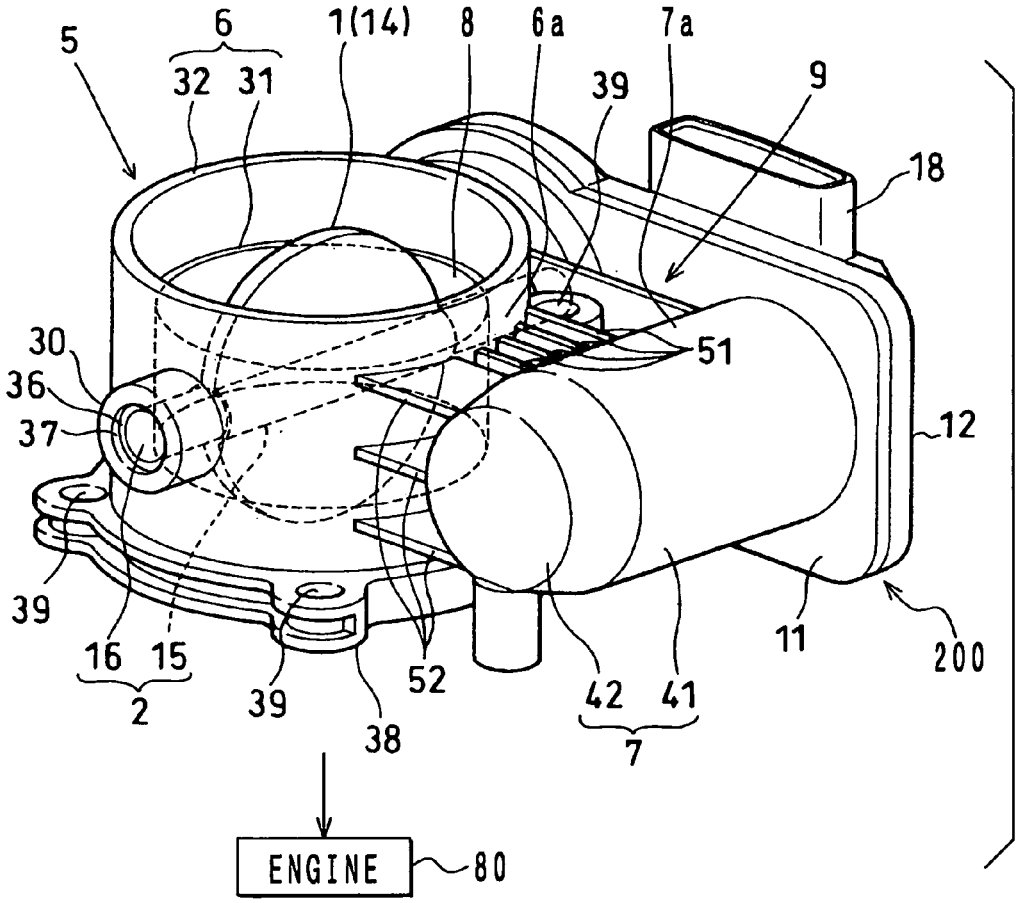
FIG. 1 is a perspective view showing an electrically controlled throttle apparatus according to a first embodiment of the present invention.
Figure 2:
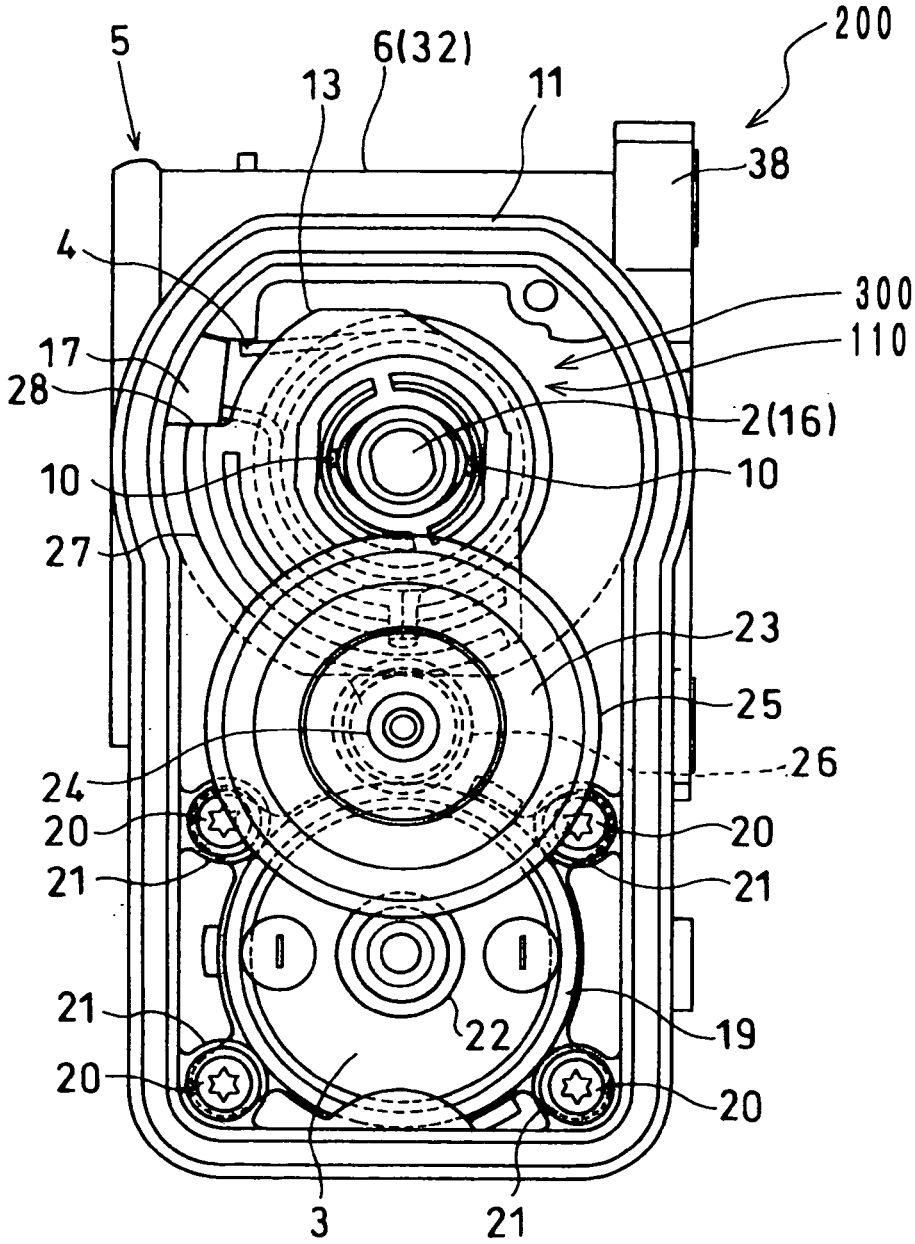
FIG. 2 is a front view showing components received in a gearbox of a throttle body provided in the electrically controlled throttle apparatus.
Figure 3:
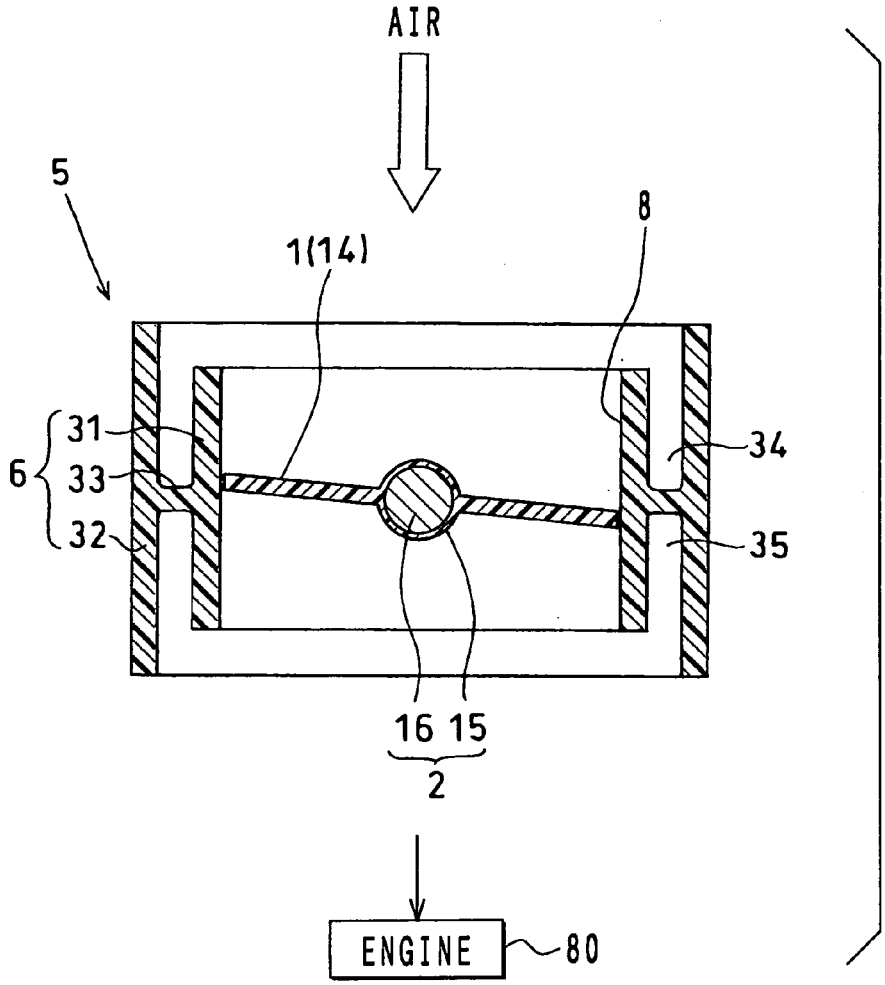
FIG. 3 is a schematic cross-sectional side view showing a double-pipe structure of a bore wall part provided in the throttle body.

As shown in FIGS. 1 to 3, an electrically controlled throttle apparatus is constructed with a throttle valve 1, a throttle shaft 2, a driving motor 3, a coil spring 4, reduction gears 300, an actuator case 200, a throttle body 5 and an ECU (electronic control unit). The throttle valve 1 controls an amount of intake air flowing into an internal combustion engine 80. The throttle shaft 2 constructs a shaft part of the throttle valve 1. The driving motor 3 rotates the throttle shaft 2, so that the throttle valve 1 is rotated in an open direction, in which the throttle valve 1 is opened to be in a full throttle position (full open position), or a close direction, in which the throttle valve 1 is closed to be in the idling position (full close position). The driving motor 3 serves as an actuator (valve operating means). The coil spring 4 urges the throttle shaft 2, so that the throttle valve 1 is rotated in the close direction. The reduction gears (power transmission unit) 300 transmit rotation power of the driving motor 3 to the throttle shaft 2 in order to integrally rotate the throttle shaft 2 and the throttle valve 1. The actuator case 200 rotatably receives the reduction gears 300. The throttle body 5 internally forms an air intake passage introducing intake air into each cylinders of the engine 80. The ECU (electronic control unit) electrically controls the driving motor 3. The ECU is connected to an accelerator position sensor (not shown) that converts an operation degree (accelerator operation amount) of an accelerator pedal stepped by a driver into an electronic signal (accelerator position signal) in order to output the accelerator position signal to the ECU. The accelerator position signal represents the accelerator operation amount. The electrically controlled throttle apparatus has a throttle position sensor 110 that converts an opening degree of the throttle valve 1 into an electronic signal (throttle position signal) in order to output the throttle position signal to the ECU. The throttle position signal represents an opening degree of the throttle valve 1. The ECU performs PID (proportional, integral and differential [derivative]) feedback control with respect to the driving motor 3 in order to eliminate deviation between the throttle position signal transmitted from the throttle position sensor 110 and the accelerator position signal transmitted from the accelerator position sensor.

The throttle position sensor 110 is constructed with permanent magnets 10, yokes (not shown), a hall element (not shown), a terminal (not shown), a stator (not shown) and the like. The permanent magnets 10 are separated rectangular magnets used for generating a magnetic field. The yokes are constructed with separated substantially arc-shaped pieces, and are magnetized by the permanent magnets 10. The hall element is integrally provided with a sensor cover 12 to be opposed to the separated permanent magnets 10. The terminal is constructed with a conductive metallic thin plate that connects the hall element to the ECU, which is externally provided with respect to the throttle position sensor 110. The stator is made of a ferrous metallic material for concentrating magnetic flux into the hall element. The separated permanent magnets 10 and the separated yokes are secured to the inner periphery of a valve gear 13, which constructs the reduction gears 300, using glue or the like.

The throttle valve 1 is a butterfly-type rotary valve for controlling an amount of intake air introduced into the engine 80. The throttle valve 1 having a substantially disc shape is integrally molded with the outer periphery of a valve supporting portion of the throttle shaft 2, so that the throttle valve 1 and the throttle shaft 2 can integrally rotate. The throttle valve 1 is made of a thermo stable resinous material, such as PPS (poly phenylene sulfide), PBTG30 (poly butylene terephthalate including grass fiber by 30%), PA (polyamide), PP (polypropylene) or PEI (polyether imide). A stiffening rib (not shown) is integrally molded on one plane face, e.g., upstream side of the intake airflow direction with respect to the resinous disc part (disc-shaped part) 14, or both plane faces of the disc-shaped part 14 of the throttle valve 1 for reinforcing the disc-shaped part 14.

Both of the end sides of the throttle shaft 2 are rotatably supported by a first bearing support and a second bearing support 30 of the throttle body 5 to be slidable each other. The axial direction of the throttle shaft 2 is arranged to be substantially perpendicular to the central axial direction of the bore wall part 6 of the throttle body 5, and is arranged to be substantially in parallel with the central axial direction of a substantially cylindrical shaped motor housing part 7. Here, the throttle shaft 2 is constructed with a resinous shaft part 15 and a metallic shaft part 16, in this embodiment. The resinous shaft part 15 serves as a valve supporting portion for supporting the throttle valve 1. The metallic shaft part 16 is formed inside of the resinous shaft part 15 by insert molding to reinforce the resinous shaft part 15.

The resinous shaft part 15 is formed in a substantially cylindrical shape. One end side of the resinous shaft part 15 of the throttle shaft 2 exposes to the outer peripheral side of the throttle shaft 2 in order to serve as a first bearing sliding part that rotatably slides with respect to the first bearing support (not shown) of the throttle body 5. The resinous shaft part 15 is made of a thermo stable resinous material, such as PPS, PBTG30, PA, PP or PEI, as well as the resinous disc part 14 of the throttle valve 1. The metallic shaft part 16 is formed in a round-bar shape, and is made of a metallic material such as stainless steel. The other side of the metallic shaft part 16 of the throttle shaft 2 exposes to the outer peripheral side of the throttle shaft 2 in order to serve as a second bearing sliding part that rotatably slides with respect to the second bearing support 30 of the throttle body 5. The valve gear 13 constructing the reduction gears 300 is integrally provided on one end side of the metallic shaft part 16 of the throttle shaft 2.

The actuator case 200 is constructed with a gearbox part (gear housing part, case body) 11 and a sensor cover (gear cover, cover) 12. The gearbox part 11 is integrally molded with an outer periphery of the bore wall part 6 of the throttle body 5 of the resinous material. The sensor cover 12 supports the hall element of the throttle position sensor 110, the terminal and the stator. The sensor cover 12 covers the opening side of the gearbox part 11.

The gearbox part 11 is made of the same resinous material as that of the bore wall part 6, and is molded in a predetermined shape to construct a gear chamber that rotatably receives the reduction gears 300. A full-close stopper 17 is integrally molded with the inner wall of the gearbox part 11 of the resinous material, for restricting rotation of the throttle valve 1 at the idling position, i.e., full close position of the throttle valve 1. Here, a full-open stopper may be integrally molded with the inner wall of the gearbox part 11 for restricting rotation of the throttle valve 1 at the full-throttle position, i.e., full open position of the throttle valve 1.

The sensor cover 12 is formed in a predetermined shape using a resinous material such as thermo plastic, in order to electrically insulate between terminals of the throttle position sensor 110 and power-supply terminals of the driving motor 3. The sensor cover 12 has an engaging part that engages with a corresponding engaged part, which is formed on the opening side of the gearbox part 11 of the throttle body 5, each other. The engaging part of the sensor cover 12 and the engaged part of the gearbox part 11 are connected using a rivet, a screw (not shown), or are thermally swaged with each other, for example. A substantially cylindrical shaped receptacle 18 is integrally molded with the sensor cover 12 to be connected with an electrical connector (not shown).

The driving motor 3 is an electrically driven actuator integrally connected with the power-supply terminals that is provided in the sensor cover 12 or the substantially cylindrical shaped motor housing part 7. When the driving motor 3 is energized, its motor shaft (not shown) is rotated in its forward direction or in its reverse direction. The driving motor 3 has a front-end frame 19 screwed onto a protrusion 21 that is provided in the motor housing part 7 or the gearbox part 11 using a fastening member 20 such as a screw. Thus, the driving motor 3 is received in the motor housing part 7. A cushion member such as a blade spring can be provided between a rear-end frame of the driving motor 3 and a bottom wall surface of the motor housing part 7 in order to insulate the driving motor 3 from vibration of the engine 80. Another cushion member can be provided between an end yoke (not shown) of the driving motor 3 and a bottom wall surface of the motor housing part 7. Alternatively, an insulation member can be provided instead of the cushion member for enhancing vibration resistant performance of the driving motor 3.

The reduction gears 300 reduce rotation speed of the driving motor 3 by a predetermined reduction gear ratio. The reduction gears 300 (valve driving means, power transmission unit) is constructed with a pinion gear 22, a middle reduction gear 23 and the valve gear 13 for driving the throttle shaft 2 that rotates the throttle valve 1. The pinion gear 22 is secured to the outer periphery of the motor shaft of the driving motor 3. The middle reduction gear 23 engages with the pinion gear 22 to be rotated by the pinion gear 22. The valve gear 13 engages with the middle reduction gear 23 to be rotated by the middle reduction gear 23.

The pinion gear 22 is made of a metallic material, and is integrally formed with the motor shaft of the driving motor 3 to be in a predetermined shape, so that the pinion gear 22 serves as a motor gear that integrally rotates with the motor shaft of the driving motor 3. The middle reduction gear 23 is formed to be in a predetermined shape of a resinous material, and is rotatably provided onto the outer periphery of the supporting shaft 24 that serves as a rotation center of the middle reduction gear 23. The middle reduction gear 23 is constructed with a large gear part 25, which engages with the pinion gear 22 of the motor shaft, and a small gear part 26 that engages with the valve gear 13. The supporting shaft 24 is integrally molded with the bottom wall of the gearbox part 11 of the throttle body 5. An end part of the supporting shaft 24 engages with a recess portion formed in the inner wall of the sensor cover 12.

The valve gear 13 is integrally molded to be in a predetermined substantially cylindrical shape of a resinous material. Gear teeth (teeth part) 27 are integrally formed in the outer periphery of the valve gear 13 to engage with the small gear part 26 of the middle reduction gear 23. A cylindrical part (not shown) is integrally molded with the valve gear 13 on the side of the bore wall part 6 to protrude in the left direction in FIG. 1. The outer periphery of the cylindrical part (spring inner periphery guide) of the valve gear 13 supports the diametrically inner periphery of the coil spring 4. A full-close stopper portion 28 is integrally formed with the valve gear 13 on one circumferentially end plane in the outer periphery of the valve gear 13, i.e., the gear teeth 27. The full-close stopper portion 28 hooks to the full-close stopper 17 of the gearbox part 11, when the throttle valve 1 is in the idling position, i.e., full close position.

The coil spring 4 is provided on the outer peripheral side of the metallic shaft part 16 of the throttle shaft 2. One end part of the coil spring 4 is supported by a body side hook (not shown) provided on the outer wall of the bore wall part 6 of the throttle body 5, i.e., bottom wall of the gearbox part 11. The other end part of the coil spring 4 is supported by a gear side hook (not shown) provided on a plane of the valve gear 13 that is located on the side of the bore wall part 6.

The throttle body 5 is a throttle housing that includes the substantially cylindrical-shaped bore wall part 6 internally forming a circular-shaped intake passage, through which intake air flows into the engine 80. The bore wall part 6 internally receives the disc-shaped throttle valve 1, such that the throttle valve 1 can open and close the circular-shaped intake passage of the bore wall part 6. The bore wall part 6 rotatably receives the throttle valve 1 in the intake passage (bore), such that the throttle valve 1 can rotate from the full close position to the full open position. The throttle body 5 is screwed onto an intake manifold of the engine 80 using a fasting bolt or a screw (not shown).

As shown in FIG. 3, the bore wall part 6 of the throttle body 5 is formed in a predetermined shape that has a double-pipe structure, in which a substantially cylindrical-shaped bore outer pipe 32 is arranged on the diametrically outer side of a substantially cylindrical-shaped bore inner pipe 31. The bore inner pipe 31 is an internal side cylindrical part that forms an internal periphery. The bore outer pipe 32 is an external side cylindrical part that forms an outer member. The bore wall part 6 of the throttle body 5 is made of a thermo stable resinous material, such as PPS, PBTG30, PA, PP or PEI. The bore inner pipe 31 and the bore outer pipe 32 have an intake-air inlet part (air intake passage) and an intake-air outlet part (air intake passage). Intake air drawn from an air cleaner (not shown) passes through an intake pipe (not shown), the intake-air inlet part and the intake-air outlet part of the bore wall part 6. Subsequently, the intake air flows into a surge tank of the engine 80 or the intake manifold. The bore inner pipe 31 and the bore outer pipe 32 are integrally molded with each other. The bore inner pipe 31 and the bore outer pipe 32 have a substantially the same inner diameter and a substantially the same outer diameter along with the intake airflow direction, i.e., the vertical direction in FIG. 3.

The bore inner pipe 31 internally has an air intake passage, through which intake air flows to the side of the engine 80. The throttle valve 1 and the throttle shaft 2 are rotatably provided in the air intake passage of the bore inner pipe 31. A cylindrical shaped space is formed between the bore inner pipe 31 and the bore outer pipe 32, and the cylindrical shaped space is circumferentially partitioned by a partition wall 33 at a substantially longitudinally central section thereof, for instance, a section along with a circumferential direction of the throttle valve 1 in the full close position. Namely, the substantially longitudinally central section of the cylindrical shaped space is a circumferential section passing through the axial center of the throttle shaft 2.

The cylindrical space between the bore inner pipe 31 and the bore outer pipe 32 located on the axially upstream side with respect to the partition wall 33 serves as a blockade recess part (moisture trapping groove) 34 for blocking moisture flowing along with the inner periphery of the intake pipe toward the intake manifold. The cylindrical space between the bore inner pipe 31 and the bore outer pipe 32 located on the axially downstream side with respect to the partition wall 33 serves as a blockade recess part (moisture trapping groove) 35 for blocking moisture flowing along with the inner periphery of the intake manifold.

Referring back to FIG. 1, the bore inner pipe 31 and the bore outer pipe 32 has the cylindrical first bearing support and the cylindrical second bearing support 30. The first bearing support rotatably supports the first bearing sliding part of the resinous shaft part 15 of the throttle shaft 2. The second bearing support 30 rotatably supports the second bearing sliding part of the metallic shaft part 16 of the throttle shaft 2 via a dry bearing 36. A circular-shaped first shaft hole (not shown) is formed in the first bearing support, and a circular-shaped second shaft hole 37 is formed in the second bearing support 30. A plug (not shown) is provided on the second bearing support 30 for plugging the opening side of the second bearing support 30.

The first bearing support is integrally molded with the outer wall of the bore wall part 6, i.e., bottom wall of the gearbox part 11 of the throttle body 5, to be protruded in the right direction in FIG. 1. The outer periphery of the first bearing support serves as the spring inner periphery guide (not shown) for supporting the diametrically inner periphery of the coil spring 4. A stay part 38 is integrally molded of the resinous material on the outer periphery of the bore outer pipe 32. The stay part 38 is connected with a connecting end face of the intake manifold of the engine 80 using a fastening member such as a bolt (not shown), when the throttle body 5 is mounted on the engine 80. The stay part 38 is provided on the outer wall of the bore outer pipe 32 located on the lower end side in FIG. 1. The stay part 38 radially outwardly protrudes from the outer wall surface of the bore outer pipe 32, and has an insertion hole 39 through which the fastening member such as the bolt passes.

The motor housing part 7, which receives the driving motor 3, is integrally molded of the resinous material with the bore wall part 6 via a connecting member 9 to construct the throttle body 5. The motor housing part 7 is arranged in parallel with the bore wall part 6. That is, the motor housing part 7 is in parallel with the bore wall part 6 with respect to the gearbox part 11 in the throttle body 5. The motor housing part 7 is arranged on the radially outer side of the sidewall face 6*a* of the bore outer pipe 32 of the bore wall part 6 having the double-pipe structure, with respect to the central axial direction of the bore wall part 6.

The motor housing part 7 is integrally molded of the resinous material with the gearbox part 11. Specifically, the motor housing part 7 is integrally molded with the end face of the gearbox part 11 located on the left side in FIG. 1. The gearbox part 11 has a chamber for rotatably receiving the reduction gears 300. The motor housing part 7 has a substantially cylindrical sidewall part 41 and a substantially circular shaped bottom wall part 42. The sidewall part 41 extends from the left side face of the gearbox part 11 in the left direction in FIG. 1. The bottom wall part 42 plugs the opening side of the sidewall part 41 on the left side in FIG. 1. The central axis of the sidewall part 41 of the motor housing part 7 is arranged substantially in parallel with the axis of the throttle shaft 2, i.e., rotation axis of the throttle valve 1. Besides, the central axis of the sidewall part 41 of the motor housing part 7 is arranged substantially perpendicularly to the central axis of the bore inner pipe 31 of the bore wall part 6.

The connecting member 9 is constructed with plural first plate-shaped ribs 51 and plural second plate-shaped ribs 52 that are integrally molded of the resinous material with the bore outer pipe 32 of the bore wall part 6 and the motor housing part 7. The plural first plate-shaped ribs 51 and the plural second plate-shaped ribs 52 protrude from the sidewall face 6*a* of the bore outer pipe 32 of the bore wall part 6, and connect to the sidewall face 7*a* of the motor housing part 7. Each of the plural first plate-shaped ribs 51 has flat faces on its both sides in a direction substantially perpendicular to the central axis of the bore outer pipe 32 of the bore wall part 6. Each of the flat faces of the first plate-shaped rib 51 has substantially the same width and substantially the same length with respect to each other. Besides, each of the plural second plate-shaped ribs 52 has flat faces on its both sides in a direction substantially in parallel with the central axis of the bore outer pipe 32 of the bore wall part 6. Each of the flat faces of the second plate-shaped rib 52 has substantially the same width and substantially the same length with respect to each other.

The plural first plate-shaped ribs 51 are arranged, such that the thickness direction of the plural first plate-shaped ribs 51 becomes substantially perpendicular to the central axis of the bore outer pipe 32 of the bore wall part 6. Besides, the plural first plate-shaped ribs 51 are arranged substantially in parallel with each other in the direction that is substantially perpendicular to the central axis of the bore outer pipe 32 of the bore wall part 6. The plural second plate-shaped ribs 52 are arranged, such that the thickness direction of the plural second plate-shaped ribs 52 becomes substantially in parallel with the central axis of the bore outer pipe 32 of the bore wall part 6. Besides, the plural second plate-shaped ribs 52 are arranged substantially in parallel with each other in the direction that is substantially in parallel with the central axis of the bore outer pipe 32 of the bore wall part 6.

In this embodiment, thickness of each of the plural first plate-shaped ribs 51 is uniformly set at the same value over its length and over its width. Likewise, thickness of each of the plural second plate-shaped ribs 52 is also uniformly set at the same value over its length and over its width. Besides, the thickness of each of the plural first plate-shaped ribs 51 is set at a value that is equal to or less than the thickness of the bore outer pipe 32 of the bore wall part 6. Likewise, the thickness of each of the plural second plate-shaped ribs 52 is also set at a value that is equal to or less than the thickness of the bore outer pipe 32 of the bore wall part 6. That is, the first plate-shaped ribs 51 are arranged to be apart from each other by a distance that is equal to or greater than the thickness of the bore outer pipe 32 of the bore wall part 6. Besides, the second plate-shaped ribs 52. are arranged to be apart from each other by a distance that is equal to or greater than the thickness of the bore outer pipe 32 of the bore wall part 6. Distance between adjacent first plate-shaped ribs 51 is set at a value that is equal to or greater than the thickness of each of the plural first plate-shaped ribs 51. Likewise, distance between adjacent second plate-shaped ribs 52 is set at a value that is equal to or greater than the thickness of each of the plural second plate-shaped ribs 52.

As follows, a molding process of the throttle body 5 is described in accordance with FIGS. 1 to 3. A molding die includes slide cores for forming components such as the air intake passage formed inside of the bore wall part 6, the first shaft hole and the second shaft hole 37, the gearbox part 11, the motor housing part 7, the plural first plate-shaped ribs 51 and the plural second plate-shaped ribs 52. Here, the slide core (slide pin) is a slidable loose bar (loose piece) used in a molding die for molding a product that has an undercut part. The undercut part cannot be molded with a simple molding die constructed with two pieces, for example. Specifically, the slide core is inserted into the molding die before injecting a thermoplastic, and the slide core is pulled out of from the molding die after the injected thermoplastic is cooled to be solidified.

Heated thermo plastic (filler), such as PPS or PBT in a molten state is injected into at least one gate of the molding die, so that a cavity formed in the molding die is filled with the filler (molten resinous material). The filler filled in the cavity of the molding die is taken out, and is cooled to be solidified. Alternatively, the filler filled in the cavity of the molding die is cooled to be solidified in the cavity. Thus, a throttle body 5 can be integrally molded of the filler (resinous material). Here, the throttle body 5 includes a bore wall part 6 having the double-pipe structure constructed with the cylindrical bore inner pipe 31 that is arranged inside of the cylindrical bore outer pipe 32. Simultaneously, the gearbox part 11, which rotatably receives the reduction gears 300, can be integrally molded of the filler (resinous material) with the outer wall of the bore outer pipe 32 of the bore wall part 6. Additionally, the substantially cylindrical-shaped motor housing, which receives the driving motor 3, can be integrally molded of the filler (resinous material) with the sidewall of the bore outer pipe 32 of the bore wall part 6 via the plural first plate-shaped ribs 51 and the plural second plate-shaped ribs 52.

As follows, an operation of the electrically controlled throttle apparatus is described. When the driver steps the accelerator pedal of the vehicle, the accelerator position signal, which is transmitted from the accelerator position sensor to the ECU, changes. The ECU controls electric power supplied to the driving motor 3, so that the motor shaft of the driving motor 3 is rotated and the throttle valve 1 is operated to be in a predetermined position. The torque of the driving motor 3 is transmitted to the valve gear 13 via the pinion gear 22 and the middle reduction gear 23. Thus, the valve gear 13 rotates by a rotation angle corresponding to the stepping degree of the accelerator pedal, against urging force generated by the coil spring 4. Therefore, the valve gear 13 rotates, and the throttle shaft 2 also rotates by the same angle as the rotation angle of the valve gear 13, so that the throttle valve 1 rotates from its full close position toward its full open position in the open direction. As a result, the air intake passage formed in the bore inner pipe 31 of the bore wall part 6 of the throttle body 5 is opened by a predetermined degree, so that rotation speed of the engine 80 is changed to be a rotation speed corresponding to the stepped degree of the accelerator pedal by the driver.

By contrast, when the driver releases the accelerator pedal, the throttle valve 1, the throttle shaft 2, the valve gear 13 and the like return to an initial position of the throttle valve 1 by urging force of the coil spring 4. The initial position of the throttle valve 1 is an idling position or the full close position. Alternatively, when the driver releases the accelerator pedal, the value of the accelerator position signal transmitted by the accelerator position sensor becomes substantially 0%. Therefore, in this situation, the ECU can supply electric power to the driving motor 3 in order to rotate the motor shaft of the driving motor 3 in its reverse direction, so that the throttle valve 1 is controlled at its full close position. In this case, the throttle valve 1 can be rotated in the close direction by the driving motor 3.

The throttle valve 1 rotates in the close direction by urging force of the coil spring 4 until the full-close stopper portion 28 provided on the valve gear 13 contacts the full-close stopper 17 integrally molded on the inner wall of the gearbox part 11 of the throttle body 5. Here, the close direction is a direction, in which the throttle valve 1 closes the air intake passage by rotating from the full open position to the full close position. Rotation of the throttle valve 1 is restricted by the full-close stopper 17 at the full close position of the throttle valve 1. Therefore, the throttle valve 1 is maintained in the predetermined full close position, i.e., idling position, in the air intake passage formed in the bore inner pipe 31 of the bore wall part 6 of the throttle body 5. Thus, the air intake passage connected to the engine 80 is substantially closed, so that rotation speed of the engine 80 is set at a predetermined idling speed.

The electrically controlled throttle apparatus has the throttle body 5 integrally molded with the motor housing part 7, which receives the driving motor 3, via the connecting member 9. The motor housing part 7 is arranged substantially in parallel with the central axis of the bore wall part 6 on the radially outer side of the sidewall face 6*a* of the bore outer pipe 32 of the bore wall part 6 with respect to the central axis of the bore wall part 6 having the double-pipe structure. In this structure, both circularity of the inner periphery 8 of the bore inner pipe 31 of the bore wall part 6 and circularity of the outer periphery of the resinous disc part 14 of the throttle valve 1 affect formation of a gap between the bore inner pipe 31 and the disc part 14, when the throttle valve 1 is in the full close position. Therefore, both the circularity of the inner periphery 8 of the bore inner pipe 31 of the bore wall part 6 and circularity of the outer periphery of the resinous disc part 14 of the throttle valve 1 affect performance of the electrically controlled throttle apparatus.

In the electrically controlled throttle apparatus, the connecting member 9 connects the sidewall 6*a* of the bore outer pipe 32 of the bore wall part 6 and the sidewall 7*a* of the motor housing part 7 with each other. Therefore, the connecting member 9 needs to be rigid in order to support the driving motor 3 that is heavier compared with other resinous molded components. However, when the connecting member 9 is formed to be a thick member, a molding cycle becomes long, and the molded connecting member 9 may deform in its molding process. Therefore, in the electrically controlled throttle apparatus of the present invention, the plural first plate-shaped ribs 51 and the plural second plate-shaped ribs 52 are adopted for constructing the connecting member 9.

Specifically, the plural first plate-shaped ribs 51 are arranged, such that the thickness direction of the plural first plate-shaped ribs 51 becomes substantially perpendicular to the central axis of the bore outer pipe 32 of the bore wall part 6. Besides, the plural first plate-shaped ribs 51 are arranged substantially in parallel with each other in the direction that is substantially perpendicular to the central axis of the bore outer pipe 32 of the bore wall part 6. The plural second plate-shaped ribs 52 are arranged, such that the thickness direction of the plural second plate-shaped ribs 52 becomes substantially in parallel with the central axis of the bore outer pipe 32 of the bore wall part 6. Besides, the plural second plate-shaped ribs 52 are arranged substantially in parallel with each other in the direction that is substantially in parallel with the central axis of the bore outer pipe 32 of the bore wall part 6. Therefore, the inner periphery 8 of the bore inner pipe 31 of the bore wall part 6 can be restricted from deformation due to contraction of the portion around the motor housing part 7. Therefore, circularity of the inner periphery 8 of the bore inner pipe 31 of the bore wall part 6 can be maintained.

Furthermore, when thickness of each of the plural first and second plate-shaped ribs 51 and 52 is greater than the thickness of the bore outer pipe 32 of the bore wall part 6, an amount of contraction of a portion around the motor housing 7 becomes large. Alternatively, when rigidity of the plural first and second plate-shaped ribs 51 and 52 becomes greater than rigidity of the bore outer pipe 32 of the bore wall part 6, the shape (bore inner periphery shape) of the inner periphery 8 of the bore inner pipe 31 of the bore wall part 6 may be deformed. Preferably, rigidity of the plural first and second plate-shaped ribs 51 and 52 is properly set, so that the plural first and second plate-shaped ribs 51 and 52 can absorb strain caused in the throttle body 5, in order to maintain circularity of the bore inner pipe 31 of the bore wall part 6. Therefore, thickness of the bore outer pipe 32 of the bore wall part 6 is set at a value equal to or greater than thickness of each of the first and second plate-shaped ribs 51 and 52. Accordingly, a portion around the motor housing 7 can be restricted from being largely contracted, and the rigidity of each ribs 51 and 52 can be equal to or less than the rigidity of the bore outer pipe 32, dissimilarly to a situation, in which thickness of each ribs 51 and 52 is greater than the thickness of the bore outer pipe 32. Thus, the shape of the bore inner periphery 8 of the bore inner pipe 31 of the bore wall part 6 can be restricted from being deformed.

Figure 6:
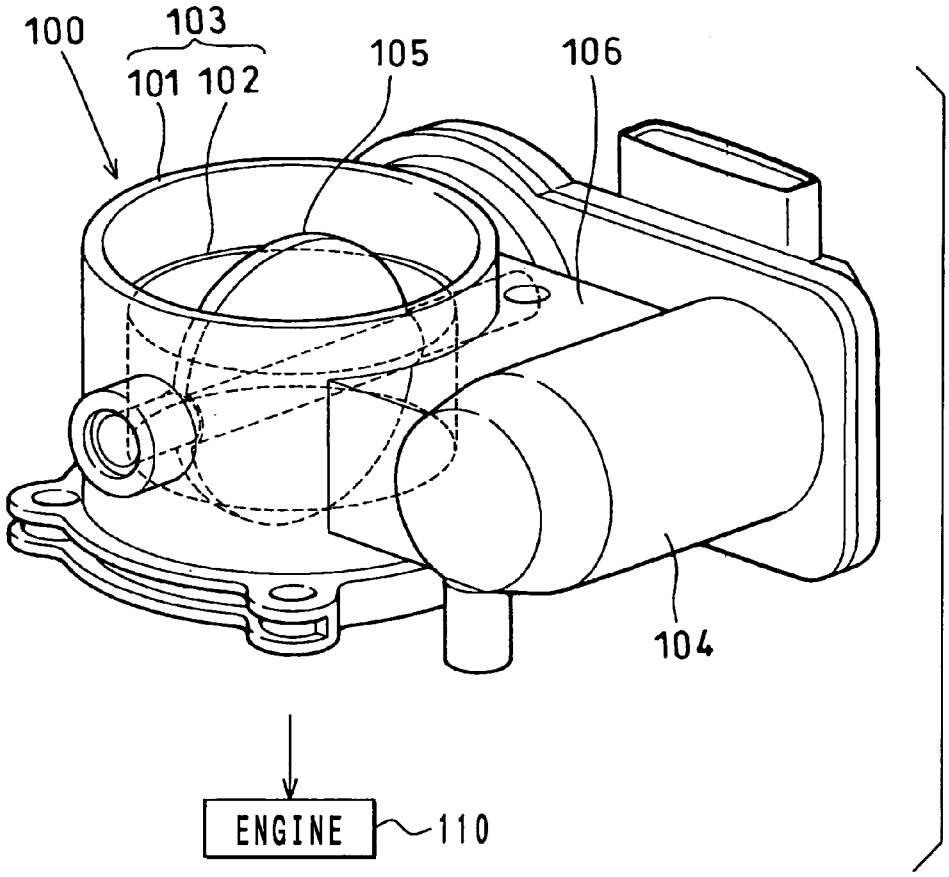
FIG. 6 PRIOR ART
FIGS. 6 and 7 are perspective views showing an electrically controlled throttle apparatus according to a prior art.
Figure 7:
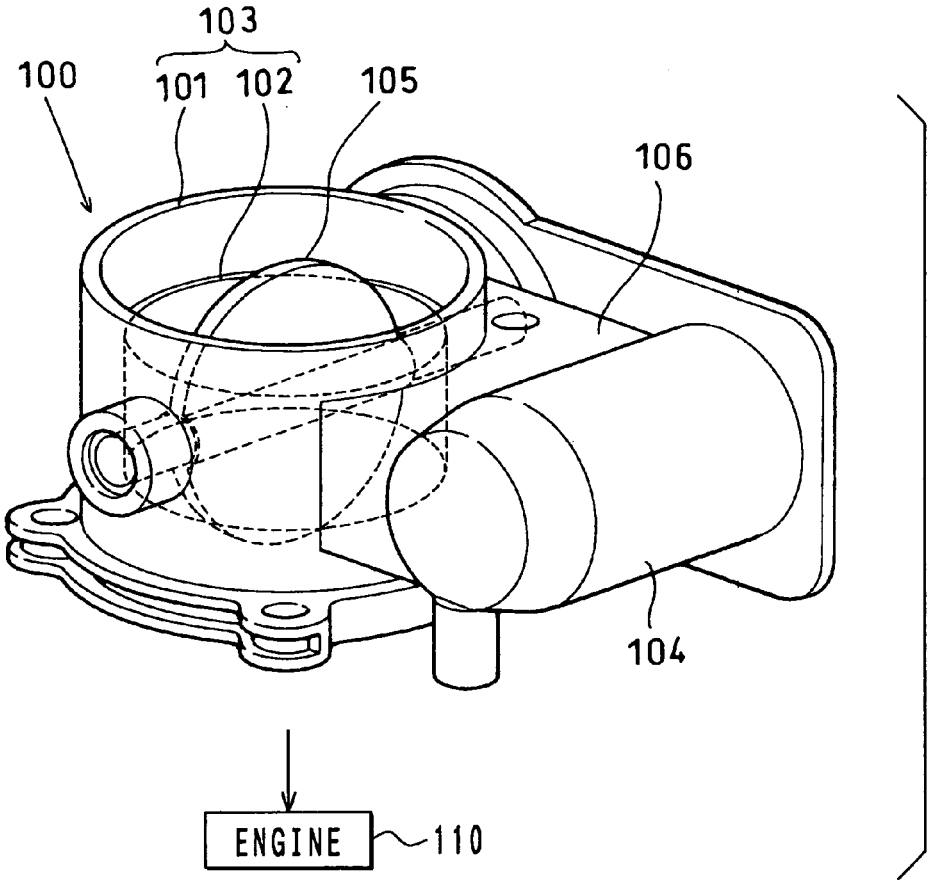
FIG. 7 PRIOR ART

Therefore, in the electrically controlled throttle apparatus of the present invention, circularity of the inner periphery 8 of the bore inner pipe 31 of the bore wall part 6 can be restricted from degradation due to contraction of a portion around the motor housing 7, compared with the conventional electrically controlled throttle apparatus shown in FIGS. 6 and 7. Thus, interference between the throttle valve 1 and the bore inner pipe 31 of the bore wall part 6 can be restricted over a rotation range (rotation angle range) of the throttle valve 1 from its full close position to its full open position. Furthermore, a gap, which is formed between the cylindrical inner periphery 8 of the bore inner pipe 31 of the bore wall part 6 and the outer circumferential periphery of the throttle valve 1, can be set at a predetermined degree when the throttle valve 1 is in the full close position in the idling operation. Accordingly, airtightness can be maintained when the throttle valve 1 is in the full close position, and leakage of intake air in the idling operation can be decreased. The amount of fuel, for instance gasoline, consumed in the engine 80 is controlled in accordance with a flow amount of intake air. Accordingly, reduction of the leakage of intake air in the idling operation contributes to improvement of fuel efficiency of the vehicle.

Furthermore, the same resinous material such as a thermo plastic, e.g., PPS or PBT may be used for constructing the bore wall part 6 having the double-pipe structure, the throttle body 5 including the motor housing part 7 and the resinous disc part 14 of the throttle valve 1. Therefore, the gap formed between the circular inner periphery 8 of the bore inner pipe 31 of the bore wall part 6 and the outer circumferential periphery of the resinous disc part 14 of the throttle valve 1 can be restricted from variation caused by a change of ambient temperature due to difference of a linear expansion coefficient of the respective resinous material.

Second Embodiment

In the structure of the throttle body 5 of the first embodiment as described above, a resinous flow may not be uniform between a portion, in which the plural second plate-shaped ribs 52 are not molded, and another portion, in which the plural second plate-shaped ribs 52 are molded. Therefore, difference of molecular orientation by a resinous flow and difference of orientation of fiber included in the filler material may be caused. Accordingly, a contraction amount of a portion, in which the plural second plate-shaped ribs 52 are not molded, and a contraction amount of another portion, in which the plural second plate-shaped ribs 52 are molded, may be largely different.

Figure 4:
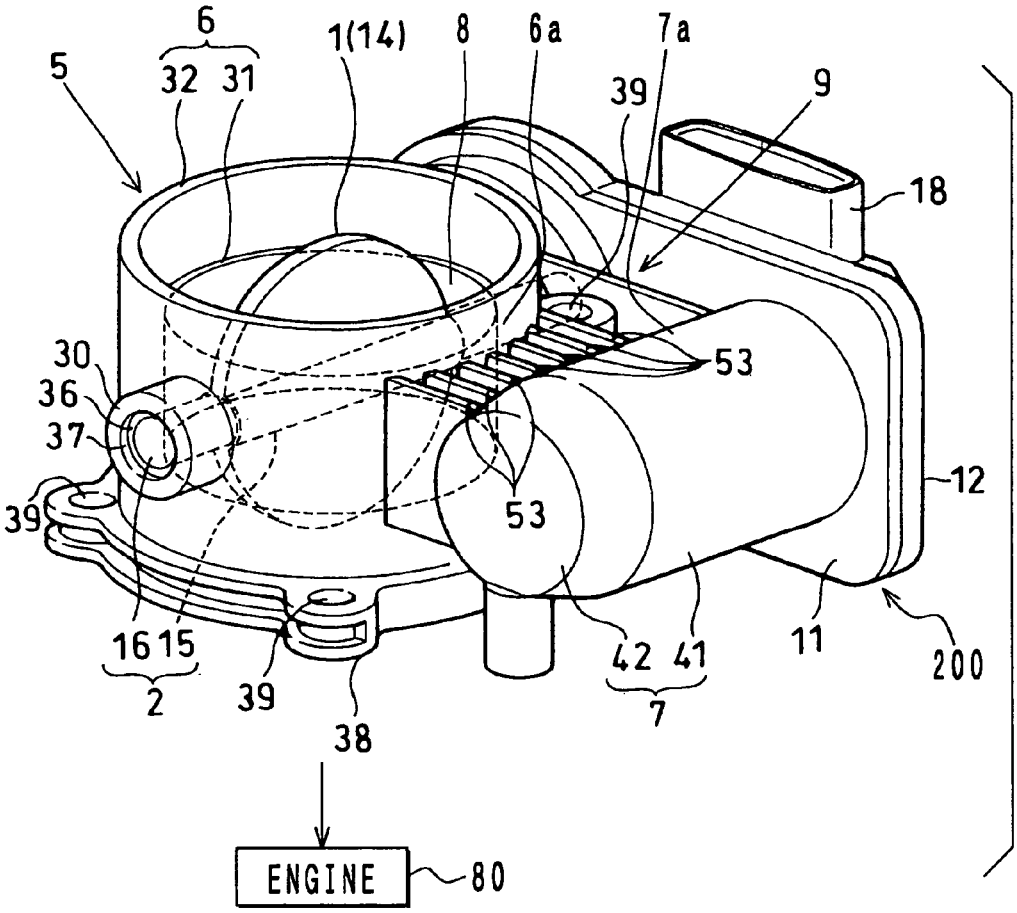
FIG. 4 is a perspective view showing an electrically controlled throttle apparatus according to a second embodiment of the present invention.

Thus, as shown in FIG. 4, plural plate-shaped ribs 53 are formed to construct a connecting member 9 of the throttle body 5 in the second embodiment for connecting between the sidewall 6*a* of the bore outer pipe 32 of the bore wall part 6 and the sidewall 7*a* of the motor housing part 7. The plural plate-shaped ribs 53 are arranged, such that the thickness direction of the plural plate-shaped ribs 53 becomes substantially perpendicular to the central axis of the bore outer pipe 32 of the bore wall part 6. Besides, the plural plate-shaped ribs 53 are arranged substantially in parallel with each other in the direction that is substantially perpendicular to the central axis of the bore outer pipe 32 of the bore wall part 6.

Accordingly, a resinous flow can be uniform between a portion, in which the plural plate-shaped ribs 53 are not molded, and another portion, in which the plural plate-shaped ribs 53 are molded, compared with the structure having both of the plural first and second plate-shaped ribs 51 and 52 in the first embodiment. Therefore, a portion around the motor housing 7 can be restricted from contraction caused by molecular orientation due to a resinous flow and orientation of fiber included in the resinous filler material. That is, an amount of contraction can be decreased between a portion, in which the plural plate-shaped ribs 53 are not molded, and another portion, in which the plural plate-shaped ribs 53 are molded. Therefore, circularity of the inner periphery (bore inner periphery) 8 of the bore inner pipe 31 of the bore wall part 6 can be restricted from degradation due to contraction of a portion around the motor housing 7, so that the electrically controlled throttle apparatus can be restricted from degradation of performance when the throttle valve 1 is in the full close position.

Third Embodiment

Figure 5:
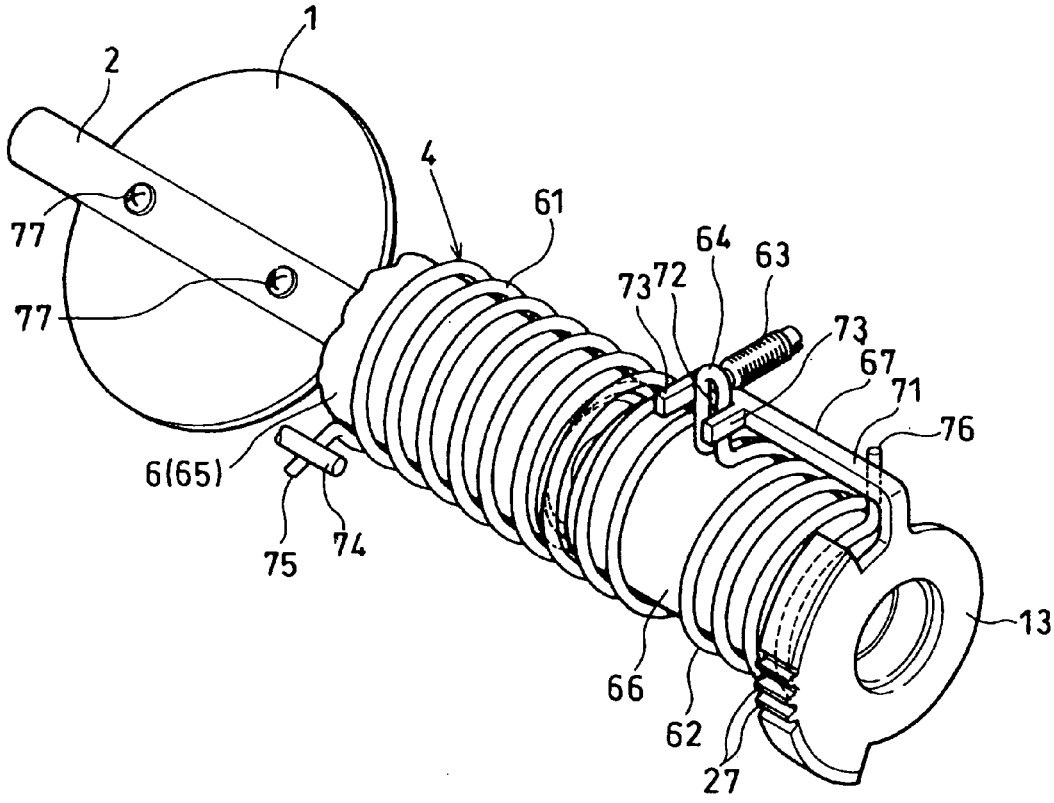
FIG. 5 is a perspective view showing an inner mechanism of the electrically controlled throttle apparatus according to a third embodiment of the present invention.

As shown in FIG. 5, the electrically controlled throttle apparatus in the third embodiment has a coil spring 4 constructed with a first spring part (return spring) 61 and a second spring part (default spring) 62. The return spring 61 serves as a returner spring and the default spring 62 serves as an opener spring. The return spring 61 and the default spring 62 are integrated into one coil spring (valve forcing means) 4 that urges a throttle valve 1 in the close direction and in the open direction of the throttle valve 1. The coil spring 4 is arranged between the outer wall of the bore wall part 6, i.e., bottom wall of the gearbox part 11 and a plane of the valve gear 13 that is located on the side of the bore wall part 6. A connecting member between the return spring 61 and the default spring 62 is bent to be in a substantially U-shape to serve as a U-shaped hook part 64 supported by a middle stopper member 63. Both sides of the coil spring 4 are wound in different directions from each other. That is, the return spring 61 is wound in one direction, and the default spring 62 is wound in the opposite direction with respect to the winding direction of the return spring 61.

A boss-shaped middle position stopper (not shown) is provided in the gearbox part 11 of the throttle body 5, such that the middle position stopper internally protrudes in the gearbox part 11. A middle stopper member 63 (adjust screw) is screwed into the middle position stopper for mechanically maintaining the throttle valve 1 at a predetermined middle position using urging force of the return spring 61 and urging force of the default spring 62 when power supplied to the driving motor 3 is terminated. The urging force of the return spring 61 and the urging force of the default spring 62 are applied in different directions from each other. The predetermined middle position of the throttle valve 1 is a position between the full close position and the full open position. A cylindrical spring inner periphery guide 65 is integrally molded with the outer wall of the bore wall part 6, i.e., bottom wall of the gearbox part 11 of the throttle body 5, to be protruded in the right direction in FIG. 5. The outer periphery of the spring inner periphery guide 65 supports the diametrically inner periphery of the coil spring 4. Another cylindrical spring inner periphery guide 66 is integrally formed with the plane of the valve gear 13 that is located on the side of the bore wall part 6. The cylindrical spring inner periphery guide 66 protrudes in the left direction in FIG. 5. The outer periphery of the spring inner periphery guide 66 supports the diametrically inner periphery of the coil spring 4.

An opener member 67 is integrally molded of a resinous material with the valve gear 13 in this embodiment. The opener member 67 is located on the side of the bore wall part 6 with respect to the valve gear 13, and is urged by the default spring 62 from the full close position toward the middle position in the open direction. A gear-side hook (second hooking part) 71, a hooking part 72 and slip restricting guides 73 are integrally formed with the opener member 67.

The gear-side hook 71 hooks to one end of the default spring 62 of the coil spring 4. The hooking part 72 detachably hooks to the U-shaped hook part 64 connecting the return spring 61 and the default spring 62. The slip restricting guides 73 are arranged near the hooking part 72 for restricting movement of the U-shaped hook part 64 in the axial direction of the coil spring 4.

A spring body-side hook (first hooked part) 75 is provided on one end side of the return spring 61 of the coil spring 4, which is located on the side of the bore wall part 6. The spring body-side hook 75 hooks to a body-side hook 74 (first hooking part) that is integrally formed with the outer wall of the bore wall part 6, i.e., bottom wall of the gearbox part 11 of the throttle body 5. A spring gear-side hook (second hooked part) 76 is provided on the side of the default spring 62 of the coil spring 4, which is located on the side of the valve gear 13. The spring gear-side hook 76 hooks to the gear-side hook (second hooking part) 71 of the opener member 67.

In the third embodiment, the throttle valve 1 is formed of a metallic material or a resinous material to be in a substantially disc-shape. The throttle valve 1 is inserted into a valve insertion hole (not shown) formed in a valve supporting portion of a throttle shaft 2, and screwed onto the throttle shaft 2 using a fastening member 77, such as a screw. The throttle shaft 2 is formed of a metallic material or the like to be in a round-bar shape, for example. Both of the end sides of the throttle shaft 2 is rotatably supported by the first bearing support and the second bearing support of the bore wall part 6 of the throttle body 5 to be slidable each other. Therefore, the throttle valve 1 and the throttle shaft 2 can be integrally rotated.

As follows, an operation of the electrically controlled throttle apparatus, when power supplied to the driving motor 3 is terminated, is described. The hooking part 72 of the opener member 67 contacts the U-shaped hook part 64 of the coil spring 4, while the opener member 67 is inserted between the connecting end part of the default spring 62, i.e., the U-shaped hook part 64, and the spring gear-side hook 76. In this situation, the hooking part 72 and the U-shaped hook part 64 are urged onto each other by urging force of the return spring 61 and urging force of the default spring 62 used as the opener spring. Here, the return spring 61 returns the throttle valve 1 from its full open position to its full close position via the opener member 67. The default spring 62 returns the throttle valve 1 from its full close position to its middle position via the opener member 67. Thus, the throttle valve 1 can be maintained at the middle position, so that a fall back operation, i.e., failsafe operation can be performed when power supplied to the driving motor 3 is terminated.

Other Embodiment

A hall IC or a magnetoresistive element or the like can be used as a noncontact sensor, instead of the hall element. A cylindrical-shaped permanent magnet can be used as a magnetic field source, instead of the separated permanent magnets 10. A substantially disc-shaped resinous disc part (disc-shaped part) 14 and a substantially cylindrical shaped resinous shaft part (cylindrical-shaped part) 15 can construct a throttle valve (resinous valve) 1, and only a substantially cylindrical shaped metallic member can construct a throttle shaft (metallic shaft) 2.

The outer periphery of the valve supporting portion of the throttle shaft 2 can be knurled partially or entirely. That is, a rough surface can be formed on the outer periphery of the valve supporting portion, so that a sticking characteristic (connecting performance) can be enhanced between the inner periphery of the resinous shaft part 15 of the throttle valve 1 and the outer periphery of the valve supporting portion of the throttle shaft 2. Namely, a serration, notches, grooves or the like are partially or entirely formed on the outer periphery of the valve supporting portion, so that relative displacement are restricted between the throttle valve 1 and the throttle shaft 2 in the axial direction thereof. Thus, the throttle valve 1 can be prevented from being pulled out of the valve supporting portion of the throttle shaft 2. Alternatively, the cross-section of the valve supporting portion of the throttle shaft 2 can be formed in a substantially circular shape having a bolt width. In this structure, the valve supporting portion of the throttle shaft 2 has substantially parallel flat faces along with its axial direction. Alternatively, the cross-section of the resinous shaft part 15 of the throttle valve 1 can be formed in a substantially cylindrical shape having a bolt width. In this structure, resinous shaft part 15 has substantially parallel flat faces along with its axial direction. In this case, relative displacement can be restricted between the throttle valve 1 and the throttle shaft 2 in the rotation direction thereof. A resinous shaft can be used as the throttle shaft 2. In this case, the resinous shaft can be integrally molded of a resinous material with the resinous shaft part 15 of the throttle valve 1, so that the number of components of the throttle valve 1 can be reduced.

The central axis of the bore inner pipe 31 can be eccentrically arranged with respect to the central axis of the bore outer pipe 32 to construct the bore wall part 6 having an eccentric double-pipe structure. That is, the axial center of the bore inner pipe 31 can be eccentrically arranged on an internally one side of the bore outer pipe 32 in the radial direction of the bore outer pipe 32, e.g., vertically lower side of the bore outer pipe 32 in its installation condition. Here, the radial direction of the bore wall part 6 is perpendicular to the axial direction of the bore wall part 6. Alternatively, the axial center of the bore inner pipe 31 can be eccentrically arranged on internally another side of the bore outer pipe 32 in the radial direction of the bore outer pipe 32, e.g., vertically upper side of the bore outer pipe 32 in its installation condition. Alternatively, the bore wall part 6 of the throttle body 5 may has a single pipe structure.

The blockade recess parts 34, 35 are formed between the bore inner pipe 31 and the bore outer pipe 32 for blocking moisture or liquid flowing into the bore wall part 6 from both of the upstream and the downstream sides of the throttle valve 1. The blockade recess parts 34, 35 are used to restrict the throttle valve 1 from icing in a cold period such as winter, without additional components, such as an additional piping member for introducing engine-cooling water into the throttle body 5. Alternatively, only the blockade recess part 34 can be provided in the bore wall part 6 for blocking moisture or liquid flowing from the upper side of the throttle valve 1 into the bore wall part 6 along with the inner periphery of the intake pipe. Thus, the number of the parts of the electrically controlled throttle apparatus can be decreased, so that the throttle apparatus can be downsized, and can be produced at a low cost.

A bypass passage can be provided on the outer peripheral side of the bore outer pipe 32 for bypassing the throttle valve 1. Furthermore, an idling speed control valve (ISC valve) can be provided in the bypass passage for controlling idling speed of the engine 80 by adjusting a flow amount of air passing through the bypass passage. An outlet port of blowby gas discharged from a positive crankcase ventilator (PCV) or a purge tube connected to a vapor recovery equipment for recovering vaporized gasoline may be connected to the intake pipe located on the upstream side of intake air flow with respect to the bore wall part 6 of the throttle body 5. In this case, engine oil contained in blowby gas may accumulate to be deposit on the inner wall of the intake pipe. However, in this structure, foreign material such as mist or deposit of blowby gas flowing along with the inner wall of the intake pipe can be blocked by the blockade recess part 34, so that the throttle valve 1 and the throttle shaft 2 can be restricted from occurrence of a failure.

Various modifications and alternations may be made to the above embodiments without departing from the spirit of the present invention.

What is claimed is:

1. An electrically controlled throttle apparatus comprising:

a throttle body including:

a motor;

a throttle valve that is rotated by the motor;

a bore wall part that rotatably receives the throttle valve;

a motor housing part that receives the motor; and a plurality of connecting members that connect the bore wall part and the motor housing part with each other, wherein the bore wall part, motor housing part and the connecting members are integrally molded, and each of the connecting members has a plate-shape.

2. An electrically controlled throttle apparatus according to claim 1, wherein the motor housing part is arranged on a radially outer side of the bore wall part via the connecting members, the connecting members protrude from a sidewall face of the bore wall part, and the connecting members connect to a sidewall face of the motor housing part.

3. An electrically controlled throttle apparatus according to claim 1, wherein the connecting members are arranged, such that a thickness direction of the connecting members becomes substantially perpendicular to a central axis of the bore wall part, and the connecting members are arranged substantially parallel to each other in a direction that is substantially perpendicular to the central axis of the bore wall part.

4. An electrically controlled throttle apparatus according to claim 1, wherein each of the connecting members has a thickness that is equal to or less than a thickness of the bore wall part.

5. An electrically controlled throttle apparatus according to claim 1, further comprising:

a throttle shaft that integrally rotates with the throttle valve; and a power transmission unit that transmits rotating power of the motor to the throttle shaft, wherein the throttle shaft has an axis that is arranged to be substantially perpendicular to a central axis of the bore wall part, and the axis of the throttle shaft is arranged to be substantially parallel to a central axis of the motor housing part.

6. An electrically controlled throttle apparatus according to claim 1, wherein the bore wall part has a substantially cylindrical shape.

7. An electrically controlled throttle apparatus according to claim 1, wherein the throttle valve has a substantially disc-shape.

8. An electrically controlled throttle apparatus according to claim 1, wherein the bore wall part includes:

an inner pipe through which intake air passes into an internal combustion engine; and an outer pipe that is arranged on a radially outer side with respect to the bore inner pipe to define a substantially cylindrical space therebetween, the inner pipe and the outer pipe are integrally molded.

9. An electrically controlled throttle apparatus according to claim 8, wherein the inner pipe and the outer pipe form a double pipe structure.

10. An electrically controlled throttle apparatus according to claim 1, wherein the throttle body and the throttle valve are made of a same resinous material.

11. An electrically controlled throttle apparatus according to claim 8, wherein the inner pipe of the bore wall part has a substantially cylindrical inner periphery that defines an intake air passage through which intake air passes, and the throttle valve opens and closes the intake air passage defined by the inner periphery of the inner pipe of the bore wall part.

12. An electrically controlled throttle apparatus according to claim 1, wherein the bore wall part has a substantially cylindrical inner periphery that defines an intake air passage through which intake air passes, and the throttle valve opens and closes the intake air passage defined by the inner periphery of the bore wall part.

13. An electrically controlled throttle apparatus according to claim 1, wherein, two of the connecting members adjacent to each other have a distance therebetween, and the distance between the adjacent connecting members is equal to or greater than the thickness of each of the connecting members.

14. An electrically controlled throttle apparatus according to claim 1, wherein the motor housing part has a substantially cylindrical shape.

15. An electrically controlled throttle apparatus according to claim 1, wherein the connecting members are plate-shaped ribs.

16. An electrically controlled throttle apparatus according to claim 1, wherein the motor housing part is arranged substantially parallel to the bore wall part.

* * * * *